US005385242A

United States Patent [19]

Freissle

[11] Patent Number: 5,385,242

[45] Date of Patent: Jan. 31, 1995

[54] SCREENING ARRANGEMENT

[76] Inventor: Manfred F. A. Freissle, 15 Oak Ave., Oakdene, Johannesburg, Transvaal Province, South Africa

[21] Appl. No.: 197,314

[22] Filed: Feb. 16, 1994

[30] Foreign Application Priority Data

Feb. 17, 1993 [ZA] South Africa ..... 93/1105
Nov. 4, 1993 [ZA] South Africa ..... 93/8247

[51] Int. Cl.[6] ..... B07B 1/46
[52] U.S. Cl. ..... 209/399; 209/408
[58] Field of Search ..... 209/399, 403, 405, 408, 209/409, 412

[56] References Cited

U.S. PATENT DOCUMENTS

| | | | |
|---|---|---|---|
| 3,980,555 | 9/1976 | Freissle | 209/399 X |
| 4,278,535 | 7/1981 | Wolff | 209/399 |
| 4,409,099 | 10/1983 | Wolff | 209/399 |
| 4,757,644 | 7/1988 | Freissle | 209/399 X |
| 4,762,610 | 8/1988 | Freissle | 209/408 X |
| 4,882,044 | 11/1989 | Freissle | 209/399 X |
| 4,885,040 | 12/1989 | Wolff | 209/399 X |
| 4,892,767 | 1/1990 | Freissle | 428/52 |
| 5,045,184 | 9/1991 | Arkles | 209/399 X |
| 5,049,262 | 9/1991 | Galton et al. | 209/399 |
| 5,248,043 | 9/1993 | Dorn | 209/399 |
| 5,277,319 | 1/1994 | Henry, Jr. | 209/399 |

FOREIGN PATENT DOCUMENTS

| | | | |
|---|---|---|---|
| 2113121 | 8/1983 | United Kingdom | 209/399 |

*Primary Examiner*—D. Glenn Dayoan
*Attorney, Agent, or Firm*—Kerkam, Stowell, Kondracki & Clarke

[57] ABSTRACT

The invention provides for a support member for a screen support frame for supporting thereon removable screening panels, the support member including securing formations which are removably inter-engageable with complementary securing formations on a screening panel. It further includes lugs extending transversely from the support member and including securing formations which are removably inter-engageable with complementary securing formations on a screening panel. The support member supports a screening panel along one peripheral side of the screening panel, and the lugs support the screening panel along a part of a transversely extending peripheral side of the screening panel.

2 Claims, 2 Drawing Sheets

SCREENING ARRANGEMENT

BACKGROUND OF INVENTION

THIS INVENTION relates to a screen support frame. More particularly the invention relates to a screen support frame for supporting removable screening panels thereon in a side-by-side abutting relationship.

A screen support frame for supporting removable screening panels thereon is known. The known screen support frame is referred to in the screening industry as a stringer support frame. It comprises a plurality of spaced parallel support members or stringers over which rectangular screening panels of a hard wearing resiliently deformable material such as polyurethane are secured. Each panel is secured to the support members along two of its parallel sides. The other two sides of each panel are not secured or supported, and each panel therefore effectively spans between the support members. While stringer support frames function quite effectively and satisfactorily, it is sometimes found that in special operating conditions, depending upon the material to be screened and the severity of the vibrations to which the frame is subjected, the screening panels can vibrate excessively and can cause excessive wear in the support members of the frame to such an extent that the panels could work loose and become adrift from the support frame, and can even crack the support member.

It is an object of the invention to provide a screen support frame which will overcome or at least alleviate the disadvantages of presently known screen support frames.

SUMMARY OF THE INVENTION

According to the invention there is provided a support member for a screen support frame for supporting thereon removable screening panels, the support member including at least one securing formation which is removably inter-engageable with a complementary securing formation on a screening panel, and at least one lug extending transversely from the support member and including at least one securing formation which is removably inter-engageable with a complementary securing formation on a screening-panel, the support member being adapted to support a screening panel along one peripheral side of the screening panel, and the lug being adapted to support the screening panel along a part of a transversely extending peripheral side of the screening panel.

Further according to the invention there is provided a screen support frame which includes at least two screen support members in accordance with the invention, the support members being positioned alongside each other and spaced from each other so that the lug of one support member is aligned with and opposite the lug on the other support member and so that a screening panel can be positioned on the support members with one peripheral side of the panel being positioned on one support member and another peripheral side of the panel being positioned on the other support member, and a transversely extending peripheral side of the panel being positioned partly over the lug of one support member and partly over the lug of the other support members.

The support member may have at least two lugs. In one configuration the lugs may be spaced from each other and may extend transversely from the support member in the same direction. In another configuration the lugs may form a pair extending transversely in opposite directions from the support member. A plurality of such pairs of lugs may be provided on the support member, the pairs being longitudinally spaced from each other.

If desired, the free end of each lug may have a rounded region. Alternatively, the lug may have a multi-sided periphery.

Conveniently, the support member may have an angular cross-sectional profile, for example of inverted L-shape. The support member may be of metal such as mild steel.

The support member may have releasable securing means for securing the support member removably on a support structure. The securing means may comprise cleats and bolts and nuts extending through the support member and through the cleats. The cleats may be welded to the support structure.

The securing formations on the support member may comprise holes in which projecting protrusions on the screening panel may fit removably.

Alternatively, the securing formations on the support member may comprise protrusions which may fit removably in complementary holes in the screening panel.

DESCRIPTION OF THE DRAWINGS

The invention is now described with reference to the accompanying drawings, in which:

Referring to FIGS. 1 and 2 of the drawings, reference numeral 10 indicates in general a screening panel to be supported on a screen support frame in accordance with the invention. The screening panel 10 is of a hard wearing synthetics plastics material such as polyurethane having a Shore hardness of from 70 to 90, depending on the type of particulate material to be screened. The panel has a screening surface 12 including a plurality of screening apertures 14. The panel 10 is of rectangular shape and has a plurality of protrusions 16 provided along the entire peripheral edge of the panel as shown. Three protrusions are shown along each peripheral edge of the panel 10, but if desired, the middle protrusion on some or all of the sides may be omitted. The protrusions 16 are pins of tapering configuration and have shoulders 18 which can abut a support frame in which the protrusions are fitted as shown in FIGS. 3 and 4. The protrusions 16 are of the same material as the panel 10 and are integral with the panel and are resiliently deformable to permit the protrusions to be inserted into and to be removed from apertures in the support frame as shown in FIG. 3.

Referring to FIG. 3, reference numeral 20 indicates in general a screen support frame in accordance with the invention. The screen support frame 20 comprises a support structure of support bars 22 and side plates 24, and support members 26. The support members 26 are angle members of inverted L-shape which are secured by means of bolts and nuts 28 to angled cleats 30 which are in turn welded to the support bars 22. The support bars 22, the side plates 24, the support members 26 and the cleats are of mild steel. The bolts and nuts 38 permit the support members to be removed e.g. for replacement or repair purposes.

Figure 3:
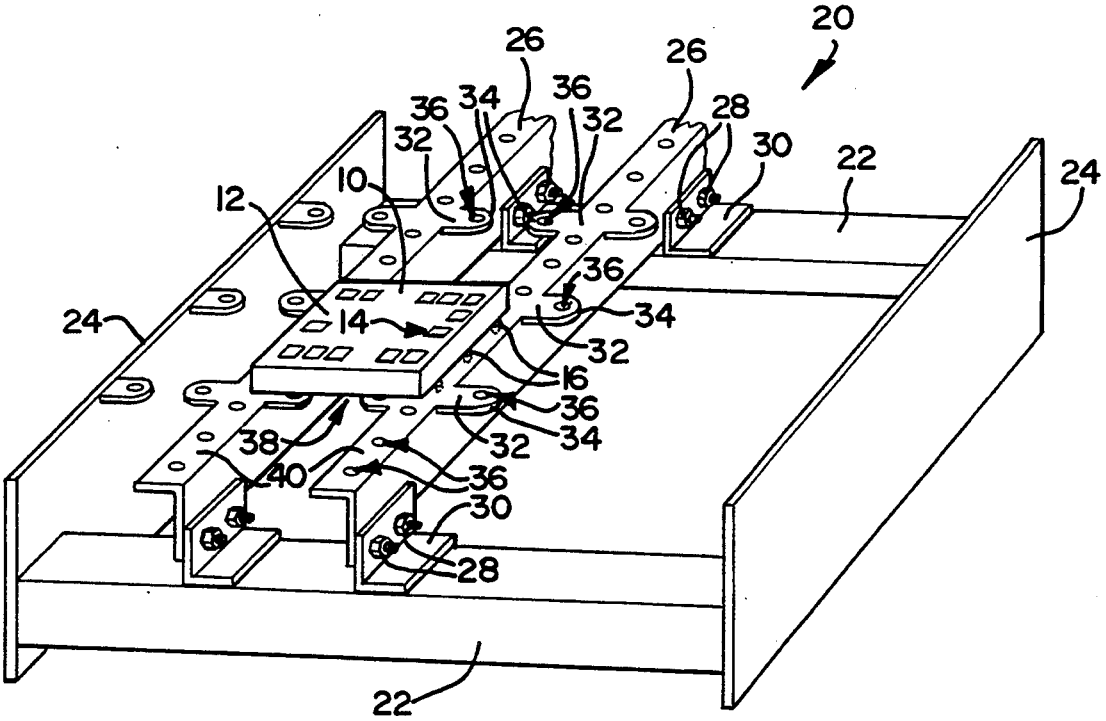
FIG. 3 shows a fragmentary three-dimensional view of a screen support frame in accordance with the invention with the screening panel in FIG. 1 located thereon.

Referring further to FIG. 3, the support members 26 have lugs 32 which extend transversely in pairs from each support member, the pairs of lugs 32 being longitudinally spaced from each other along each support member. Each lug 32 has a rounded periphery 34. Spaced holes 36 are provided in each support member 26, and a similar hole 36 is provided in each lug 32. The arrangement of the lugs 32 on each support member 26 is identical, and the support members 26 are so positioned on the support bars 26 that the lugs 32 on the support members are aligned with each other and are opposed to each other with a space 38 being formed between the opposing lugs 32.

Figure 1:
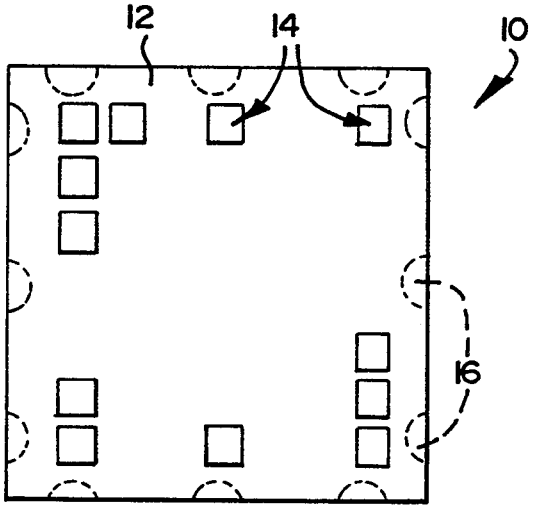
FIG. 1 shows a plan view of a screening panel to be supported on a screen support frame in accordance with the invention.
Figure 2:
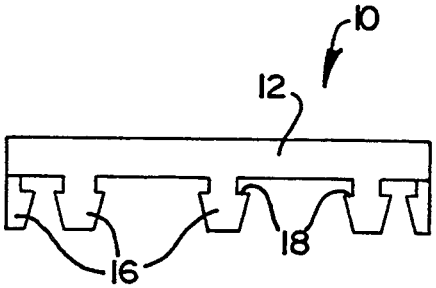
FIG. 2 shows a side view of the screening panel shown in FIG. 1.
Figure 4:
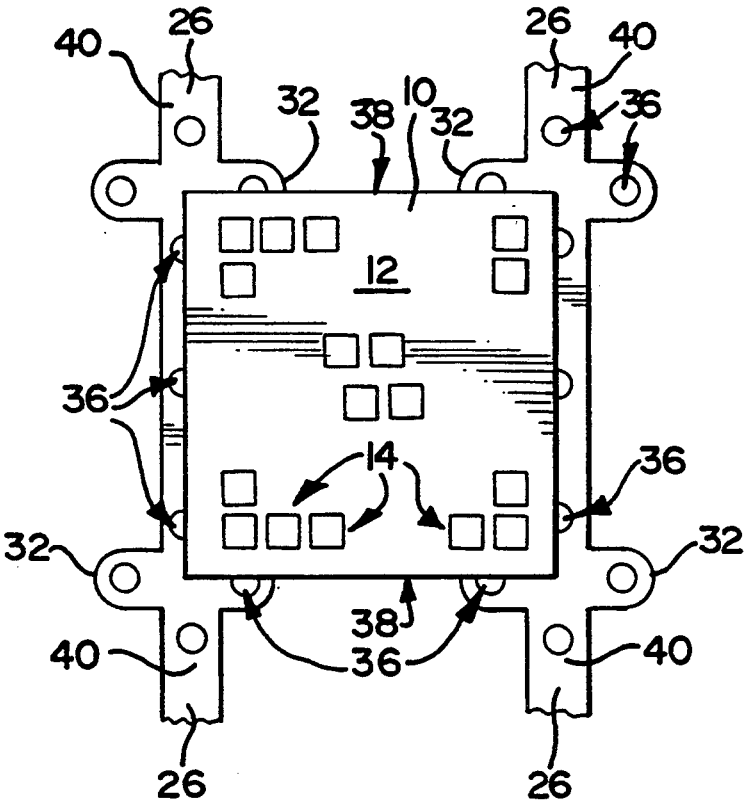
FIG. 4 shows a fragmentary plan view of the screen support frame of FIG. 3.
Figure 5:
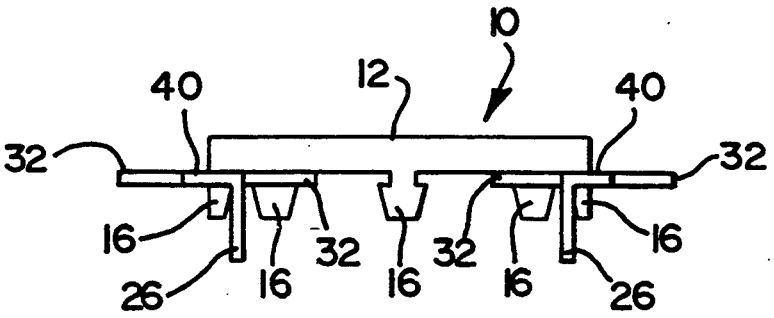
FIG. 5 is an end view of the screen panel and support frame shown in FIG. 4.

Referring further to FIG. 3, and also to FIGS. 4 and 5, the screening panel 10 shown in FIGS. 1 and 2 is positioned on the support members 26 so that the protrusions 16 are in register with the holes 36. By applying downward pressure on the screening panel 10 the protrusions 16 are forced through the holes 36 so that the shoulders 18 engage the undersides of the support members 26. Thereby the panel 10 is located on and is secured to the support members 26. The panel can, however, be removed by withdrawing the protrusions 16 from the holes 36. When the panel 10 is thus located and secured on the support members 26, the panel spans between the support members. In this position two of the protrusions 16 along each peripheral edge of the panel 10 which spans between the support members 26 are secured in the apertures 36 in the opposing lugs 32. The lugs 32 therefore provide partial support to the portion of the panel spanning between the support members 26. The third protrusion along each of these tow peripheral spanning edges is free and unsecured and in fact serves no function. Consequently, if desired, these unsecured protrusions 16 may be omitted during the manufacture of the screening panel 10.

The lugs 32 provide support to the screen panel 10 in addition to the support being provided by the support surfaces 40 of the support members 26. This additional support has the effect of preventing or resisting vibration of the screening panel 10 on the support members 26 during use when the screen support frame 20 is subjected to vibrating forces to effect screening of the material passing over the screening surfaces 12 of a plurality of screening panels 10 secured onto the support frame 20. The result is that the tendency of the protrusions 16 to move in the holes 36 and thus to wear out the holes is resisted, and consequently the tendency of the panel 10 to work loose and to become adrift from the support members 26 is resisted, and potential cracking of the frame can be avoided.

I claim:

1. A screen support frame which includes at least two screen support members, each support member including at least one securing formation which is removably inter-engageable with a complementary securing formation on a screening panel, and at least one lug extending transversely from the support member and including at least one securing formation which is removably inter-engageable with a complementary securing formation on a screening panel, the support member being adapted to support a screening panel along one peripheral side of the screening panel, and the lug being adapted to support the screening panel along a part of a transversely extending peripheral side of the screening panel, the support members being positioned alongside each other and spaced from each other so that the lug of one support member is aligned with and opposite the lug on the other support member and so that a screening panel can be positioned on the support members with one peripheral side of the panel being positioned on one support member and another peripheral side of the panel being positioned on the other support member, and a transversely extending peripheral side of the panel being positioned partly over the lug of one support member and partly over the lug of the other support member(s).

2. A screen support frame as claimed in claim 1, which includes two side plates and at least one support bar fast with and extending between and spacing apart the side plates.

* * * * *